US008129295B2

(12) United States Patent
Aasgaard

(10) Patent No.: US 8,129,295 B2
(45) Date of Patent: Mar. 6, 2012

(54) ARTICLE OF MANUFACTURE FOR WARMING THE HUMAN BODY AND EXTREMITIES VIA GRADUATED THERMAL INSULATION

(75) Inventor: Alvin L. Pepper Aasgaard, Omaha, NE (US)

(73) Assignee: Warmer Weave, Inc., Papillion, NE (US)

( * ) Notice: Subject to any disclaimer, the term of this patent is extended or adjusted under 35 U.S.C. 154(b) by 687 days.

(21) Appl. No.: 12/134,982

(22) Filed: Jun. 6, 2008

(65) Prior Publication Data

US 2009/0023353 A1 Jan. 22, 2009

Related U.S. Application Data

(60) Provisional application No. 60/933,748, filed on Jun. 8, 2007.

(51) Int. Cl.
*D03D 15/00* (2006.01)

(52) U.S. Cl. ..... 442/301; 442/414

(58) Field of Classification Search ..... 442/301, 442/414

See application file for complete search history.

(56) References Cited

U.S. PATENT DOCUMENTS

| | | | | |
|---|---|---|---|---|
| 2,350,363 | A | 6/1944 | Massa | |
| 3,508,284 | A | 4/1970 | Marquette | |
| 3,857,753 | A | 12/1974 | Hansen | |
| 4,578,096 | A * | 3/1986 | Siegmund | 65/405 |
| 5,007,125 | A * | 4/1991 | Owenby | 5/486 |
| 5,030,518 | A * | 7/1991 | Keller | 428/550 |
| 5,146,634 | A | 9/1992 | Hunt | |
| 5,150,476 | A | 9/1992 | Statham et al. | |
| 5,199,121 | A | 4/1993 | Payne | |
| 5,243,725 | A | 9/1993 | Fowler | |
| 5,299,333 | A | 4/1994 | Pedersen et al. | |
| 5,408,712 | A | 4/1995 | Brun | |
| 5,594,964 | A | 1/1997 | Boyd et al. | |
| 5,708,995 | A | 1/1998 | Wu et al. | |
| 6,643,872 | B1 | 11/2003 | Buswell | |
| 7,124,455 | B2 | 10/2006 | Demarco et al. | |
| 2003/0148081 | A1 * | 8/2003 | Moody | 428/218 |
| 2007/0275180 | A1 * | 11/2007 | Thompson et al. | 427/559 |

FOREIGN PATENT DOCUMENTS

| | | | |
|---|---|---|---|
| CH | 662 714 | A5 | 10/1987 |
| DE | 3305507 | A1 | 8/1984 |
| KR | 1020050054929 | A | 6/2005 |

OTHER PUBLICATIONS

Search Report for co-pending PCT/US2008/066160 listing relevant art cited by the International Searching Authority.

* cited by examiner

*Primary Examiner* — Lynda Salvatore
(74) *Attorney, Agent, or Firm* — McKee, Voorhees & Sease, P.L.C.

(57) ABSTRACT

An article of manufacture for warming human extremities via graduated thermal insulation with a blanket comprised of concentrations of and transitions to and from concentrations of various types of woven thread fabric or non-woven fabric, having various properties of thermal insulation.

19 Claims, 7 Drawing Sheets

ARTICLE OF MANUFACTURE FOR WARMING THE HUMAN BODY AND EXTREMITIES VIA GRADUATED THERMAL INSULATION

CROSS REFERENCE TO RELATED APPLICATION

This application claims priority under 35 U.S.C. §119 to provisional application Ser. No. 60/933,748 filed Jun. 8, 2007, herein incorporated by reference in its entirety.

FIELD OF THE INVENTION

This invention relates generally to the field of insulating fabrics, and more specifically to an article of manufacture for warming the human body and extremities via a fabric having graded or graduated thermal insulatory properties.

BACKGROUND OF THE INVENTION

It is well known that human extremities experience greater heat losses than the core of the human body. Poor circulation further contributes to discomfort associated with outer and mid extremity areas of the body. Feelings of discomfort and even pain in these areas can be accentuated in times of rest, as well as times of heightened anxiety or stress. Presently, such things as outerwear, underwear, sporting gear, bedding, and the like are manufactured from fabrics, including the fibers that make up the fabric, having constant heat insulatory properties or ratings. Shrouding the body and its mid to outer extremities with wears having constant or linear heat insulatory properties would be appropriate if heat loss from the human body and extremities, as well as circulation, was constant or linear. A warm core and cold fingers or toes is evidence of the fact that this is not the case.

Therefore, a need has been identified in the art to provide an article of manufacture, such as ones' wears, having the advantage of graduated thermal insulatory properties to meet the varying insulatory needs of the human body and extremities.

In addition to constant heat insulatory properties, existing fabrics and their fibers or threads offer limited benefits to the wearer because the reflective and absorptive properties associated with the fibers or threads are constant as well.

Therefore, a need has been identified in the art to provide an article of manufacture, such as ones' wears, having the advantage of graduated reflective or absorptive properties associated with the fibers or threads to meet the varying reflective or absorptive needs of the human body and extremities.

SUMMARY OF THE INVENTION

Other objects and advantages of the present invention will become apparent from the following descriptions taken in connection with the accompanying drawings, wherein, by way of illustration and example, an embodiment of the present invention is disclosed.

According to one aspect of the present invention, an article of manufacture having the advantage of providing graduated thermal insulatory properties to meet the varying insulatory needs of the human body and extremities is disclosed. In a preferred form, the thermally graded fiber has: an increasing fiber diameter or decreasing fiber diameter along one or more spans of the fabric; an increasing thermal insulatory property or decreasing thermal insulatory property along one or more spans of the fabric; or the thermally graded fiber may include a blended fiber with increasing or decreasing amounts of fibers having higher insulatory properties than the non-thermally graded fiber, or a blended fiber with increasing or decreasing amounts of fibers having lower insulatory properties than the non-thermally graded fiber.

According to another aspect of the present invention, an article of manufacture having the advantage of providing thermally graded properties to meet the varying insulatory needs of the human body and extremities is disclosed. The article includes a fabric of woven fibers having graded thermal insulatory properties provided by gradually varying ratios of one fiber to another fiber along one or more spans of the fabric. In a preferred form, the woven fibers include a non-thermally graded fiber blended with at least one: (a) thermally graded fiber having a hollow core of increasing or decreasing diameter; (b) thermally graded fiber of increasing or decreasing thermal insulatory properties; (c) thermally graded fiber of increasing or decreasing count; or (d) thermally graded solid core fiber. In still another preferred form, the fabric includes an absorptively or reflectively graded fiber having: an increasing ratio of reflectivity to absorptivity to increase the energy reflectance properties along one or more spans of the fabric, or an increasing ratio of absorptivity to reflectivity to increase the energy absorbance properties along one or more spans of the fabric.

BRIEF DESCRIPTION OF THE FIGURES

The drawings constitute a part of this specification and include exemplary embodiments to the invention, which may be embodied in various forms. It is to be understood that in some instances, various aspects of the invention may be shown exaggerated or enlarged to facilitate an understanding of the invention.

DETAILED DESCRIPTION OF THE PREFERRED EMBODIMENTS

Figure 1A:
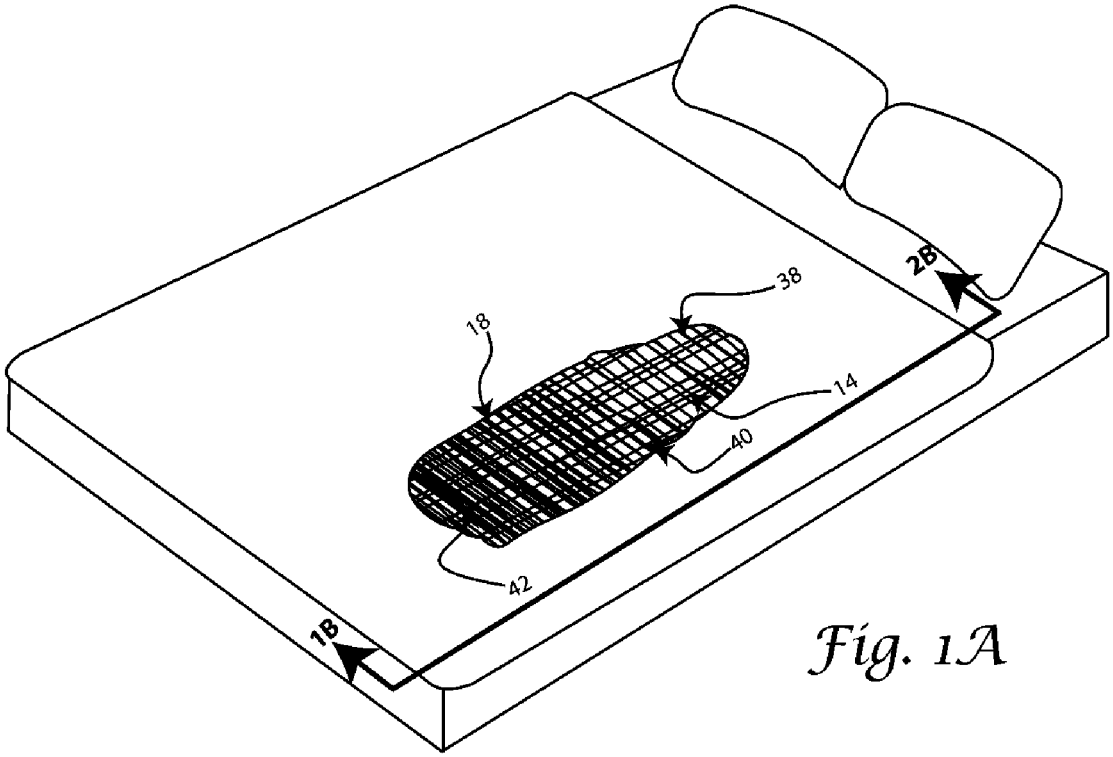
FIG. 1A is a perspective view of a bed with bedding according to an exemplary embodiment of the present invention.

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

In accordance with an exemplary embodiment of the invention, there is disclosed an article of manufacture for warming human extremities via graduated thermal insulation, which in one exemplary aspect includes a fabric having concentrations of and transitions to and from concentrations of various types of interwoven fibers or threads defined by graded or graduated thermal insulatory properties. The present invention also contemplates articles of manufacture for warming human extremities via graduated thermal insulation, which in another exemplary aspect includes a fabric having groupings of and transitions to and from groupings and/or layering schemes of various types, quantities and qualities of fabrics, woven and/or non-woven, having graded or graduated thermal insulatory properties.

FIGS. 1A-5C provide several exemplary aspects of the present invention. The present invention is not limited to the several exemplary aspects which are shown and illustrated. The present invention provides generally an article of manufacture which has the advantage of providing graduated thermal insulatory properties to meet varying insulatory needs of the human body and extremities. According to one exemplary aspect of the present invention, the article of manufacture may include a thermally graded fabric having at least a non-thermally graded fiber blended with a thermally graded fiber to meet the varying insulatory needs of the human body and its extremities. The concept of thermally grading the fabric will be further described in the preceding paragraphs and by way of exemplary aspects as further illustrated in FIGS. 1A-5C. Although specific uses for the thermally graded fabric are illustrated in the drawings, the drawings are merely exemplary embodiments or aspects of the present invention, and should not be construed as limiting the present invention to only the illustrated applications. Clearly, the concepts of the present invention could be incorporated into any type of bedding, clothing or articles worn or used to cover the human body or to insulate the body and its extremities. For example, the present invention may be incorporated into any number of humanly worn articles such as outerwear, underwear, sporting gear, cold gear, heat gear, or the like. Further, the present invention may be incorporated into various types of bedding, sheets, blankets, throws, or the like. The present invention is not limited to incorporation of the concepts into clothing or bedding, but could be incorporated into any article of manufacture wherein the fibers comprising the article of manufacture would benefit the article of manufacture by being thermally graded or having graduated thermal insulatory properties.

Figure 1B:
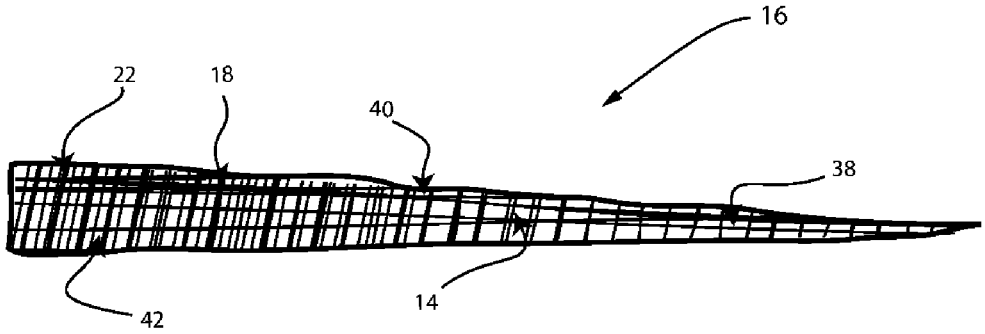
FIG. 1B is a sectional view of the bedding taken along line 1B-1B in FIG. 1A.

FIGS. 1A and 1B illustrate one exemplary aspect of the present invention. FIG. 1A illustrates a bed 10 having bedding 12. Bedding 12 is made up of fabric 16 comprised of at least fibers 14. FIG. 1A illustrates an area of bedding 12 having thermal gradation 18. The thermal gradation 18 illustrates the graduated thermal insulatory properties of fabric 16. For example, fibers 14 may be spaced or interwoven at graduated distances. Graduated weaving or spacing, as illustrated in FIG. 1B, can be accomplished by increasing the number of fibers 14 (fiber/thread count), fiber diameter, or fiber insulatory properties such that fabric 16 has a lower insulatory property section 38, mid-range insulatory property section 40, and a higher-insulatory property section 42. Thus, the graduated thermal properties of bedding 12 can meet the insulatory needs of the human body and its extremities, where for example, the lower end of bedding 12 would cover the legs and feet of an individual and provide a higher insulatory property than the portion of bedding 12 covering the core of the individual. In cases where circulation is poor or extremities of the body are cooler than the core, the bedding 12 provides fabric 16 with higher thermal insulatory gradings as you move away from the core of the individual. Similarly, fabric 16 may include thermally graded portions having a higher insulatory property moving outward from the core of the individual and along the individual's arms where the highest insulatory property would be configured into fabric 16 where bedding 12 is likely to cover these types of extremities of the individual. FIG. 1B shows but one aspect of the present invention wherein fabric 16 is thermally graded by increasing the thread or fiber count of the non-thermally graded fiber 22. Thus, as you progress along a span of fabric 16, the density of the fibers or threads, in this case, non-thermally graded fibers 32 increases to provide graduated thermal insulatory properties ranging from a lower insulatory property section 38 to a mid-range insulatory property section 40 and a higher insulatory property section 42. Those skilled in the art should appreciate that increasing the fiber or thread count is but one way of providing a thermally graded fabric. The present invention contemplates a number of variations to thermally grade the insulatory properties of the fiber 14 or fabric 16.

Figure 2A:
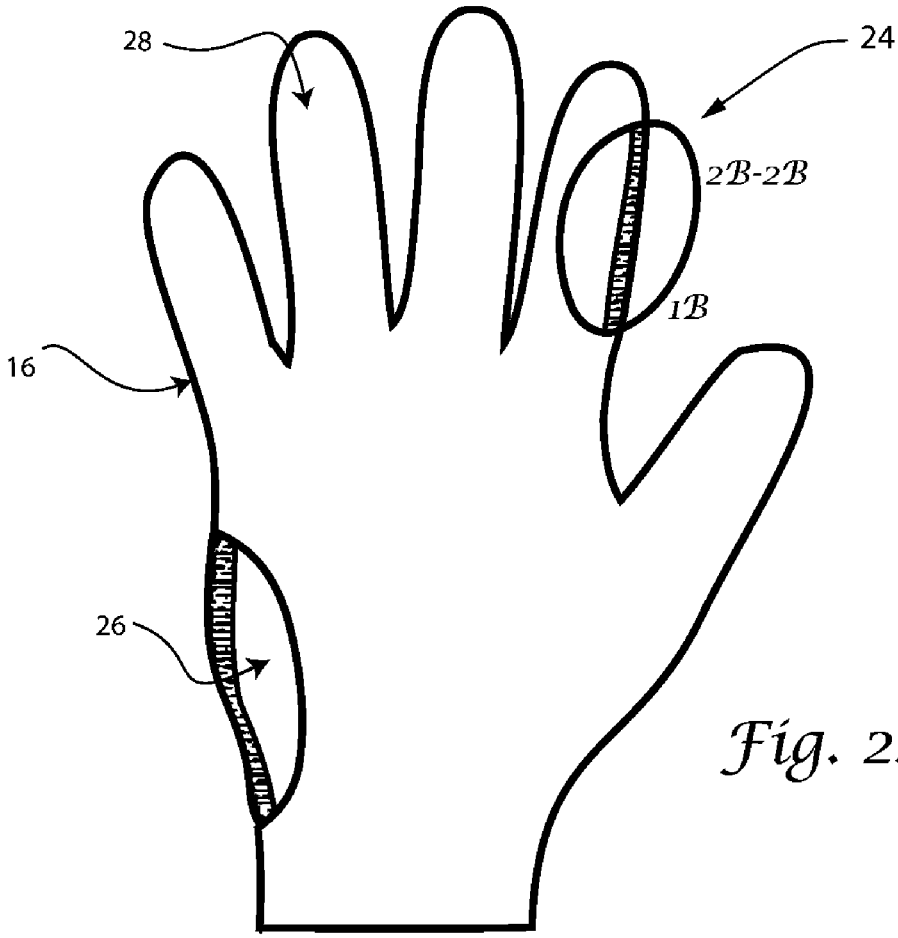
FIG. 2A is an edge view of a glove according to an exemplary aspect of the present invention.
Figure 2B:
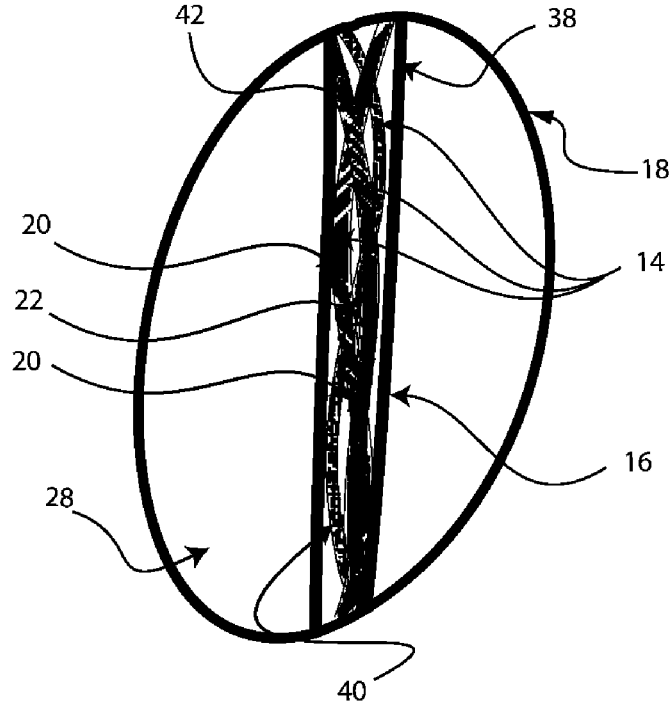
FIG. 2B is an enlarged view taken along line 2B-2B in FIG. 2A.

FIGS. 2A and 2B illustrate another exemplary aspect of the present invention and provide conceptually another way for thermally grading fabric 16. FIG. 2A illustrates a glove 24 constructed in part, if not in whole, using fabric 16 of the present invention. Like bedding 12 illustrated in FIG. 1A, glove 24 in FIG. 2A is thermally graded to provide higher insulatory properties toward the outer extremities of the hand such as fingers 28. The area of glove 24 covering fingers 28 includes thermal gradation 18 to provide graduated thermal insulatory properties to each finger 28 as well as hand 26. Thermal gradation 18 of glove 24 is best illustrated in FIG. 2B. FIG. 2B illustrates another exemplary aspect for providing graduated thermal insulatory properties according to the present invention. FIG. 2B is an exaggerated view of fibers 14 within fabric 16 that make up glove 24 covering one of the fingers 28. In this aspect of the present invention, fibers 14 have an increasing fiber diameter along the areas such as the fingertips where higher insulatory properties are needed. In addition to increasing the diameter of fibers 14, the present invention contemplates altering the fiber type in graded fashion to provide higher insulatory properties in areas such as the fingertips where a higher insulatory property is needed. Thus, thermal gradation 18 could include interweaving one or more non-thermally graded fibers 22 with any number of thermally graded fibers 20. The thermally graded fibers 20, as well as the non-thermally graded fibers 22 could have increasing fiber diameters along areas covering the outer extremities of the human body such as finger 28 of hand 26. Alternatively, thermal gradation 18 could include thermally graded fibers 20 having higher insulatory properties in areas where the fibers would cover extremities of the body; this could include thermally grading the fiber such that the thermally graded fiber 20 has a lower insulatory property section 38, a mid-range insulatory property section 40, and a higher insulatory property section 42, where these sections would be graded as you move farther away from the core of the body and into the extremities such as finger 28.

Figure 3A:
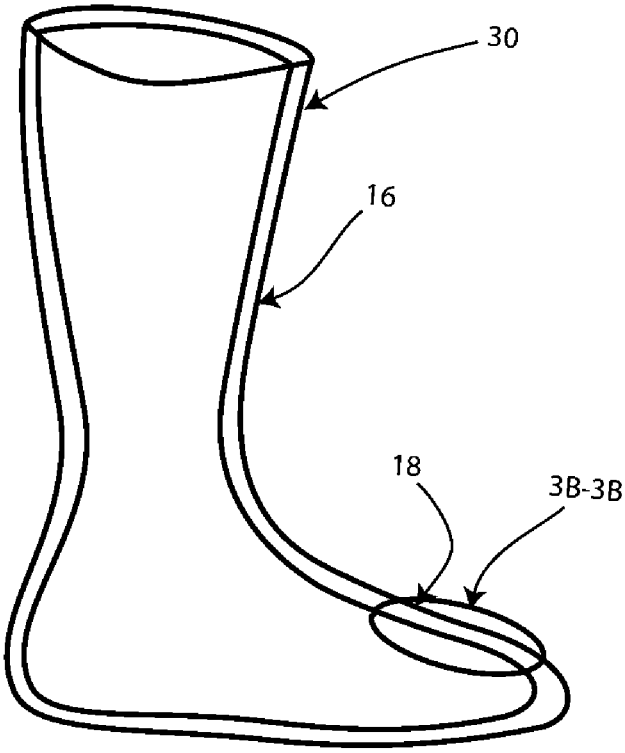
FIG. 3A is an edge view of a sock according to an exemplary embodiment of the present invention.
Figure 3B:
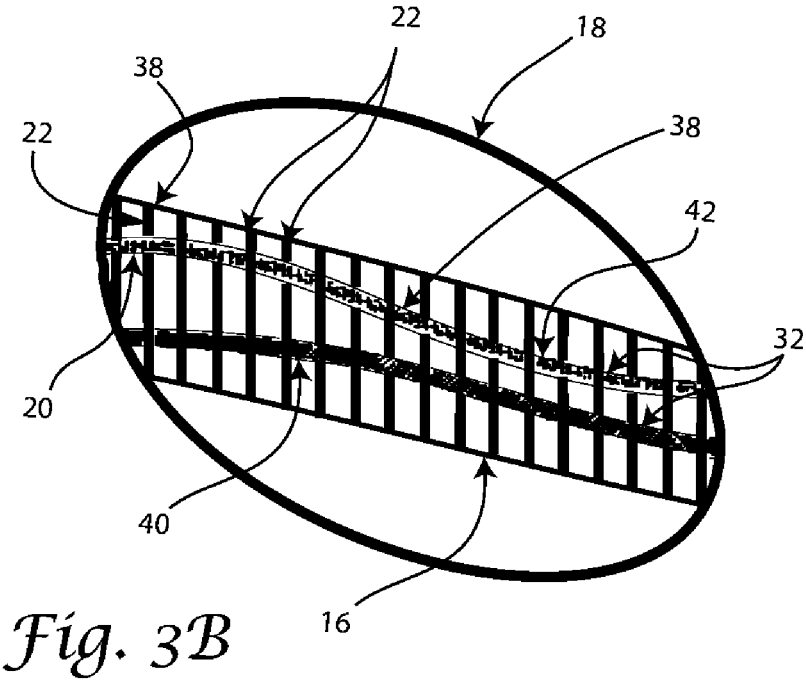
FIG. 3B is an enlarged view of the sock taken along line 3B-3B in FIG. 3A.

FIGS. 3A and 3B illustrate yet another exemplary implementation of the concepts of the present invention. Similar to glove 24 illustrated in FIG. 2A, a sock 30 having the concepts of the present invention is illustrated in FIG. 3A. Like glove 24, sock 30 has a thermal gradation 18 along one or more spans of fabric 16 to provide graduated thermal insulatory properties for extremities of the human body such as the foot. FIG. 3B illustrates the thermal gradation 18 of sock 30 according to an exemplary aspect of the present invention. FIG. 3B illustrates non-thermally graded fibers 22 being interwoven and interspaced with thermally graded fibers 20 to provide graduated thermal insulatory properties for sock 30 to manage heat retention and loss from areas of the body such as the foot and toes. According to this one aspect, thermally graded fibers 20 may include a hollow core 32 for increasing or decreasing the thermal insulatory properties at a graduated rate. Those skilled in the art of insulation understand and can appreciate that the insulatory ratings increase as the hollow core 32 of thermally graded fiber 20 is increased in diameter. Such understanding of insulation is well known and can be appreciated from other arts such as the glass industry where double panes of glass are assembled having a hollow core spaced between the two panes to provide thermal insulatory properties to the glass. By changing the spacing between the glass or the hollow core, the thermal insulatory properties of the glass may be altered. Here, the hollow core 32 of thermally graded fiber 20 increases in diameter gradually along the length of fabric 16 such that fabric 16 provides higher insulatory properties to outer extremities of the body such as the feet and toes. In another exemplary aspect of the present invention, the thermally graded fiber 20 may have a smaller diameter hollow core 32, which around the toe area of sock 30 exhibits a larger diameter hollow core 32 to provide the highest insulatory properties. Thus, thermal gradation 18 of sock 30 provides a lower insulatory property section 38 graduating into a mid-range insulatory property section 40 and further graduating into a higher insulatory property section 42 to provide a graduated thermal insulatory property to meet the varying insulatory needs of the human body and extremities, such as the feet and toes. Those skilled in the art can appreciate that non-thermally graded fiber 22 could be thermally graded as well. Similarly, thermal gradation 18 illustrated in FIG. 3B could be accomplished by any of the aforementioned or proceeding aspects of the present invention.

Figure 4A:
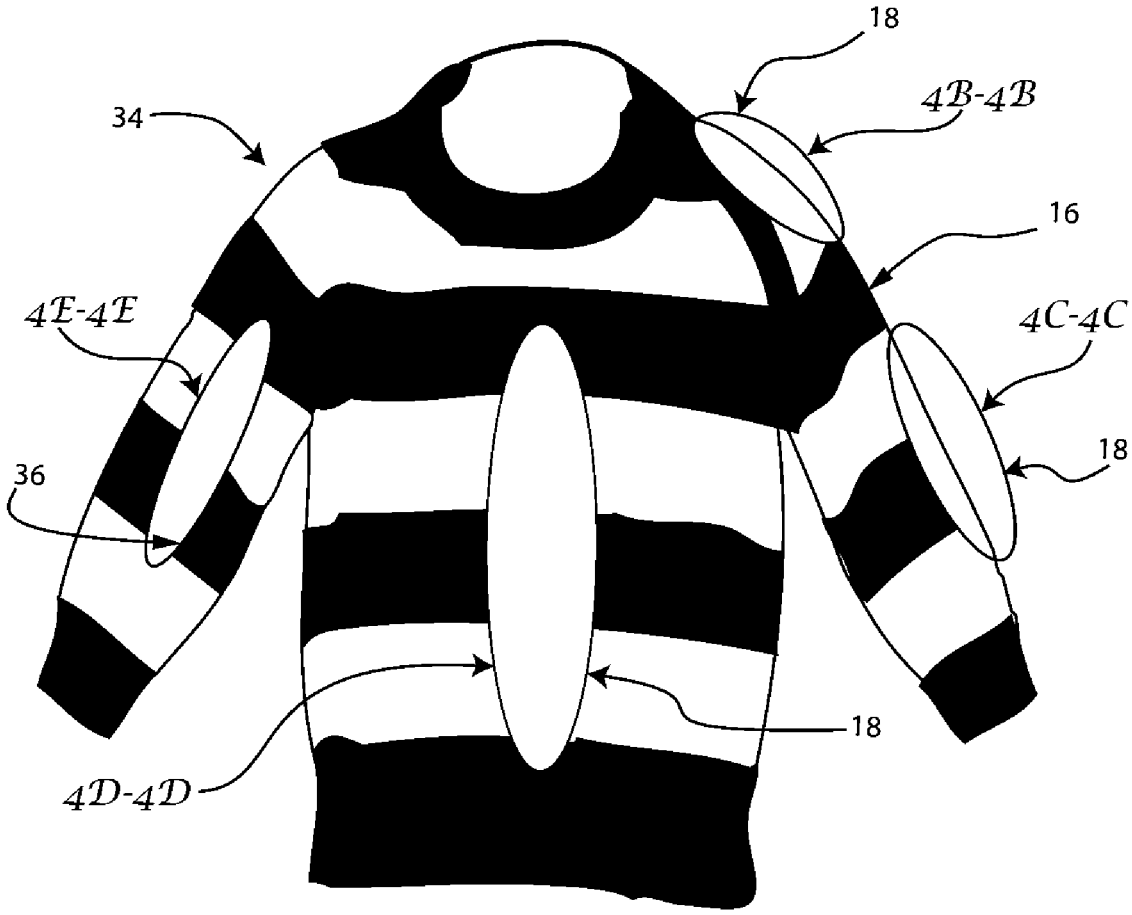
FIG. 4A is an edge view of a shirt according to an exemplary embodiment of the present invention.
Figure 4B:
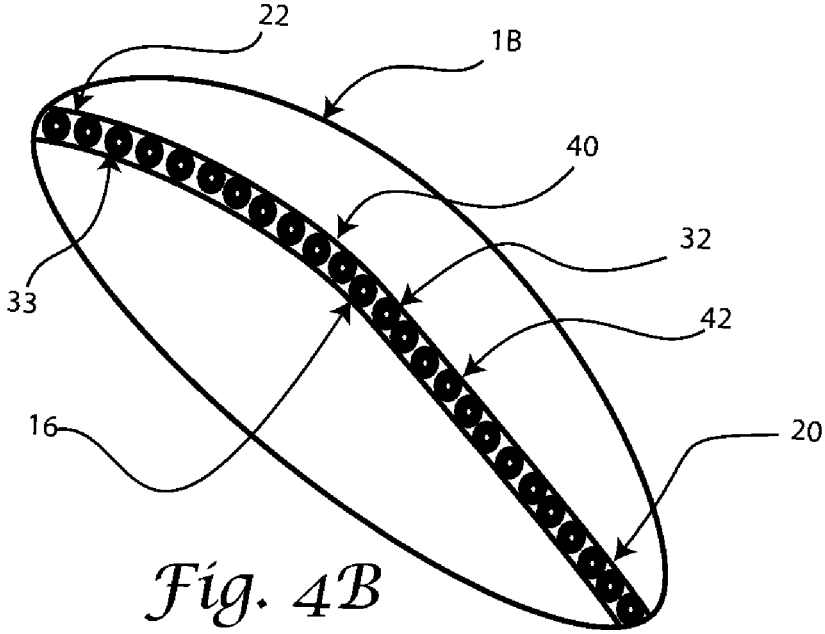
FIG. 4B is an enlarged view of the shirt taken along line 4B-4B in FIG. 4A.

FIGS. 4A-4E illustrate another exemplary aspect of the present invention. FIG. 4A illustrates the concepts of the present invention being incorporated into shirt 34. Those skilled in the art can appreciate the advantages of shirt 34 having graduated thermal properties to better accommodate the varying insulatory needs of the body including any extremities which shirt 34 covers. For illustration of several exemplary embodiments of the present invention, varying thermal gradations 18 taken along various portions of shirt 34 are illustrated in enlarged views shown in FIGS. 4B-4E. Thermal gradations 18 illustrated in FIGS. 4A-4E are not limited to the sections of shirt 34 for which they are shown, but could be applied to any portion of shirt 34 as well as other articles of clothing, bedding, or fabric used to provide and meet the insulatory needs of the human body and its extremities. Similar to FIG. 3B, FIG. 4B illustrates non-thermally graded fibers 22 being interwoven with thermally graded fibers 20. Those skilled in the art can appreciate that thermally graded fibers 20 can be interwoven with non-thermal, thermal or other graded fiber types. The thermally graded fibers 20 and non-thermally graded fiber 22 could be a naturally made fiber or thread having the desired insulatory properties or a manmade fiber or thread. Some manmade fibers for the purposes of the present invention include but are not limited to, rayon, acetate, nylon, modacrylic, olefin, acrylic, polyester, or the like. Similarly, some natural fibers for the purpose of the present invention include but are not limited to vegetable fibers such as cotton, jute, flax, ramie, sisal, and hemp, animal fibers such as silk, wool, angora, mohair and alpaca, and mineral fibers such as ceramic and metal fibers.

FIG. 4B illustrates the thermal gradation of fabric 16 along a span of shirt 34. For example, if thermal gradation 18 is desired along a specific span of shirt 34, thermally graded fibers 20 may have an increasing hollow core diameter 32 to provide higher insulatory properties compared to the area of fabric 16 having thermally graded fibers 20 with smaller diameter hollow cores 32. For example, the core of the body tends to remain warm where the extremities such as arms and hands due to circulation, external conditions, or physiochemistry of the individual may need or be best suited for fabric 16 having higher or lower thermal insulatory properties. For example, it may be desirable to provide the sleeves of shirt 34 having a higher insulatory property wherein the sleeve is thermally graded such that there is a lower insulatory property section 38 graduating into a mid-range insulatory property section 40 which in turn graduates into a higher insulatory property section 42 as the fabric 16 extends along and out toward outer extremities of the body.

Figure 4C:
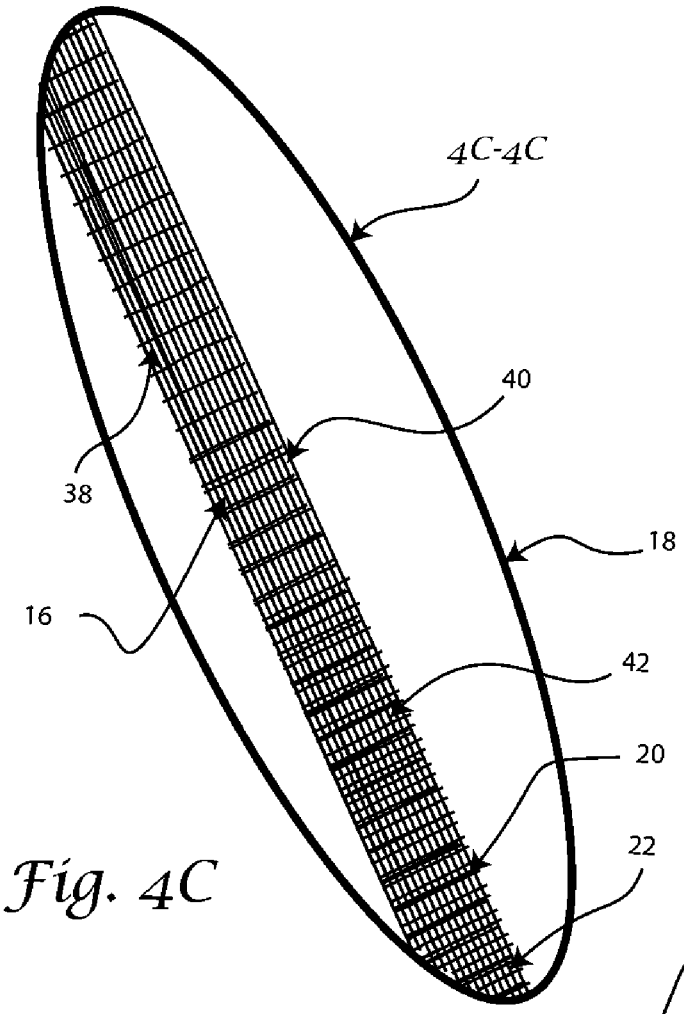
FIG. 4C is an enlarged view of the shirt taken along line 4C-4C in FIG. 4A.

FIG. 4C illustrates yet another aspect of the present invention. FIG. 4C illustrates thermally graded fibers 20 interwoven with non-thermally graded fibers 22. Thermal gradation 18 of fabric 16 is accomplished by increasing the fiber count of thermally graded fibers 20 relative to the fiber count of non-thermally graded fibers 22 along a span of fabric 16. By increasing the fiber count of the thermally graded fiber 20, fabric 16 provides graduated thermal insulatory properties; the graduated thermal properties may include a lower insulatory property section 28 graduating into a mid-range insulatory property 40 which in turn graduates into a higher insulatory property section 42 where the lower insulatory property section 38 covers a portion of the body or extremities that does not need as much thermal insulation, and the higher insulatory property covers a section of the body that has higher thermal insulatory needs. Those skilled in the art can appreciate that thermal gradation 18 illustrated in FIG. 4C may be accomplished by interweaving non-thermally graded fibers 22 at increasing fiber counts from the lower insulatory property section 38 to the higher insulatory property section 42. Additionally, thermal gradation 18 illustrated in FIG. 4C may be accomplished by any of the aforementioned or proceeding thermal gradations of the present invention.

Figure 4D:
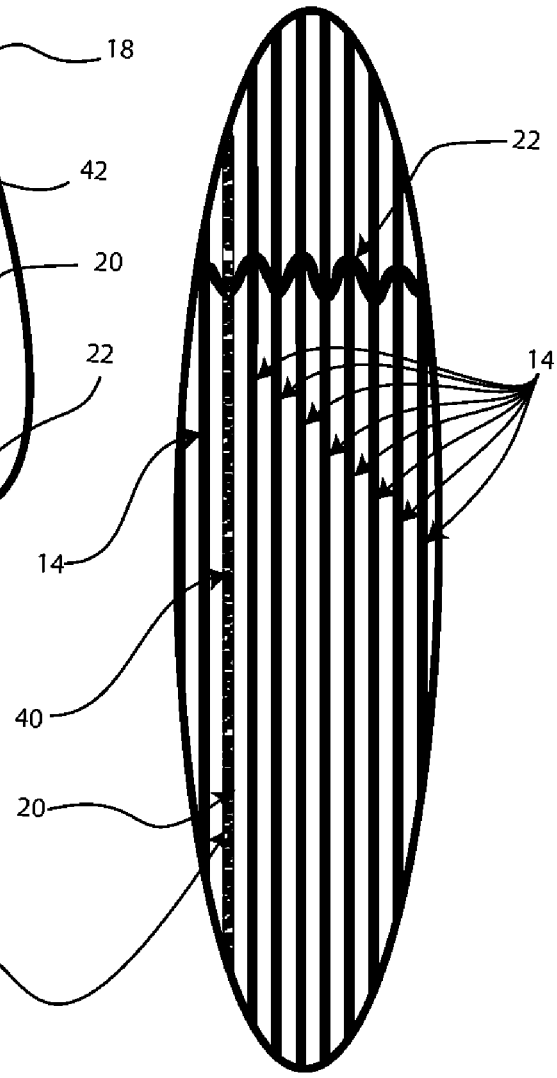
FIG. 4D is an enlarged view of the shirt taken along line 4D-4D in FIG. 4A.

FIG. 4D illustrates yet another thermal gradation 18 that may be configured into shirt 34 according to an exemplary embodiment of the present invention. FIG. 4D illustrates a thermally graded fiber 20 interwoven with a non-thermally graded fiber 22. Thermal gradation 18 is accomplished by graduating or grading insulatory properties along the span of fiber 20 to provide thermally graded fiber 20. For example, fiber 20 may include a lower insulatory property section 38 that graduates into a mid-range insulatory property section 40 which in turn graduates into a higher insulatory property section 42. One example of the thermal gradation 18 shown in FIG. 4D is illustrated in FIGS. 3B and 4B where fiber 20 is thermally graded by increasing the hollow core diameter 32 along a span of fabric 16. The aspect illustrated in FIG. 4D may also be accomplished by interweaving higher insulatory fibers or threads at increasing density in areas where higher insulatory properties are needed.

Figure 4E:
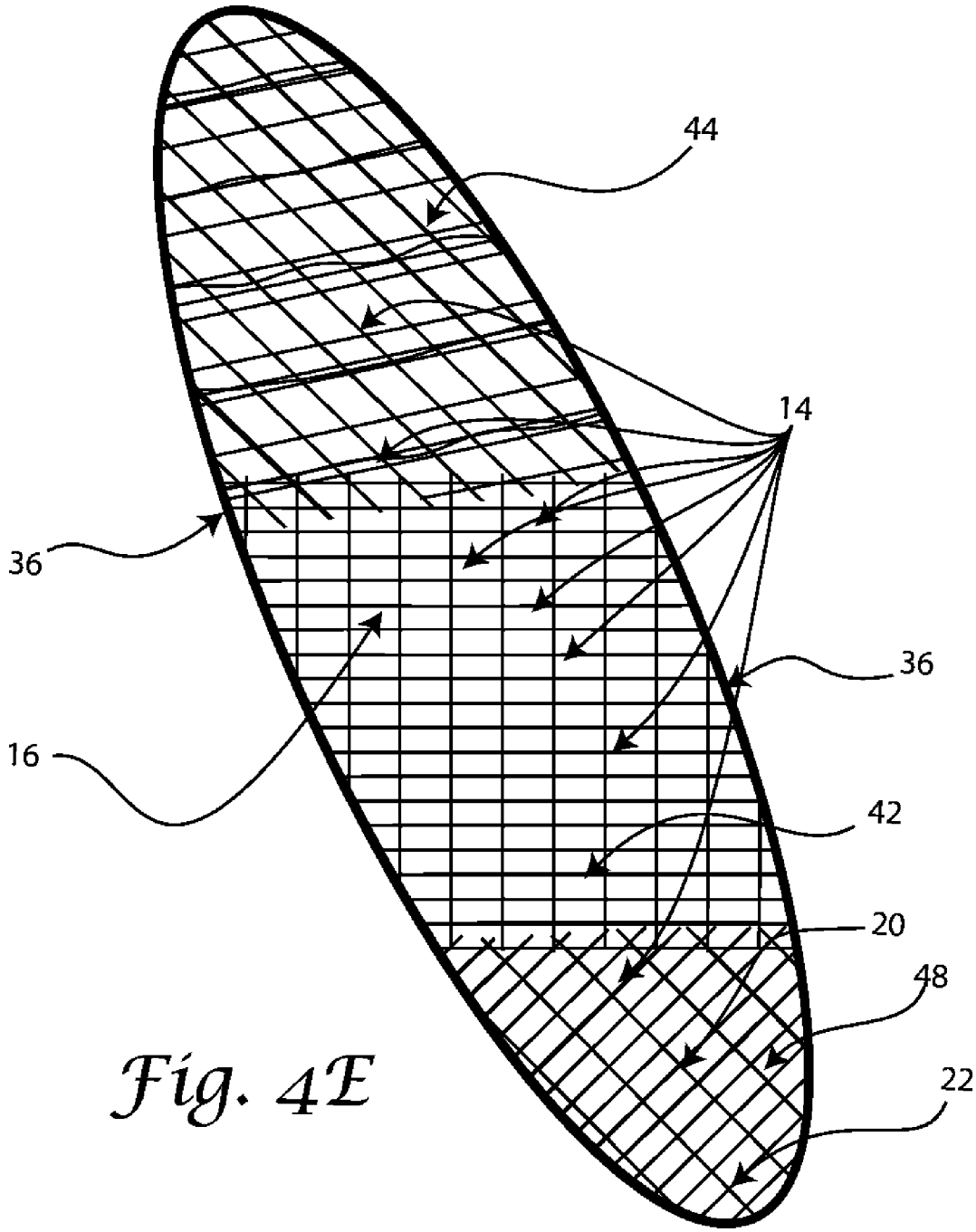
FIG. 4E is an enlarged view of the shirt taken along line 4E-4E in FIG. 4A.

FIG. 4E illustrates yet another exemplary aspect of the present invention. To this point, the present invention has focused on providing materials with graduated thermal insulatory properties to meet the varying needs of the human body and its extremities. This includes managing heat loss from the human body and extremities by covering the human body and its extremities with a fabric having graduated thermal insulatory properties. FIG. 4E illustrates yet another aspect of the present invention wherein fabric 16 includes one or more fiber types including an absorptively or reflectively graded fiber to manage in addition to heat loss from the human body, heat gain from ambient conditions such as rays from the sun impinging on fabric 16. The absorptive or reflectively graded fibers may have an increasing ratio of reflectively graded fibers to absorptively graded fibers to increase the reflective properties of fabric 16. Alternatively, the ratio of absorptively graded fibers to reflectively graded fibers may be increased to increase the absorptive properties of fabric 16. There may be instances, for example where certain sections or portions of a garment could include absorptively graded fibers or reflectively graded fibers depending upon the insulatory needs of the individual or the extremity covered by the garment. FIG. 4E illustrates fabric 16 having a lower absorptive or reflective fiber gradation section 44 that transitions or graduates into a mid-range absorptive or reflective fiber gradation section 46 which in turn graduates into a higher absorptive or reflective fiber gradation section 48. Those skilled in the art can appreciate that fabric 16 can be reflectively graded along one span and absorptively graded along another span, or vice-versa, to meet the insulatory needs of the individual. For example, where it is desired that a portion of fabric 16 absorb more energy than other portions, the absorptive/reflective gradation 36 may include a graduation of the absorptive properties of fiber 14 along a span of the fabric 16 such that one portion of fabric 16 absorbs less or more energy than another portion of fabric 16. Alternatively, fabric 16 may be configured such that a portion has a higher reflectivity than another portion. Those skilled in the art can appreciate that varying the color type of fiber 14 provides a means for controlling the absorptivity or reflectivity of fibers 14 making up fabric 16.

Figure 5A:
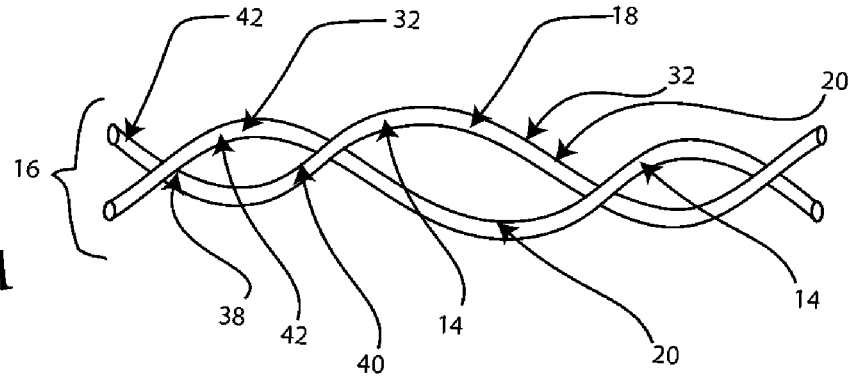
FIG. 5A is a sectional view of one fabric illustrating the fibers according to an exemplary embodiment of the present invention.
Figure 5B:
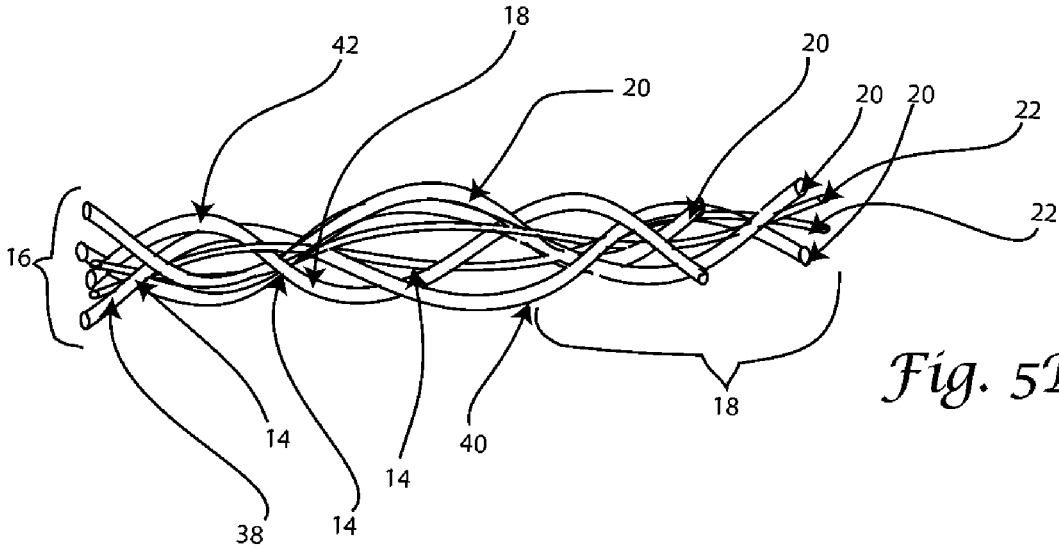
FIG. 5B is a sectional view of another fabric illustrating the fibers according to an exemplary embodiment of the present invention.

FIG. 5A illustrates one exemplary aspect of weavings of fibers 14 making up one or more of the fabrics 16 or thermally graded fibers of the present invention. FIG. 5A illustrates graduation of the thermal insulatory properties along the length of fibers 14 by controlling the hollow core diameter 32 along the length of fibers 14. As previously discussed, fibers 14 may be thermally graded or have thermal gradations 18 across their length by increasing or decreasing the hollow core diameter 32 (in the case where fiber 14 is a hollow core fiber). For example, by increasing the hollow core diameter 32 of fiber 14 along the length of fiber 14, a lower insulatory property section 38 can be graduated or blended into a mid-range insulatory property section 40 which in turn is graduated into a higher insulatory property section 42. Those skilled in the art can appreciate that the woven thermally graded fibers 20 illustrated in FIG. 5A may also include interweaving non-thermally graded fibers. FIG. 5B illustrates yet another aspect of the present invention wherein the fiber count or density increases along the length of fabric 16 to provide a lower insulatory property section 38 which graduates or blends into a mid-range insulatory property section 40 which in turn graduates or blends into a higher insulatory property section 42. Those skilled in the art can appreciate that the graduation of insulatory properties across the length of fabric 16 or fiber 14 is accomplished at a blended or graduated rate and thus is conceptually, structurally, and functionally different than materials or fabrics where materials having varying thermal insulatory properties are layered overtop of one another or where they are attached to one another as these are not representative of a graduated blending of the thermal properties of the fabric or fiber.

FIG. 5B illustrates non-thermally graded fibers 22 being interwoven and blended with thermally graded fibers 20 according to an exemplary aspect of the present invention. Those skilled in the art can appreciate that the fiber count for either the non-thermally graded fiber 22 or thermally graded fiber 20 may be increased across the length of fabric 16 to provide the desired thermal gradation 18. To achieve the desired thermal gradation 18, fabric 16 need not include a blend of thermally graded fibers 20 and non-thermally graded fibers 22, but may include a blend of thermally graded fibers 20 having varying insulatory properties.

Figure 5C:
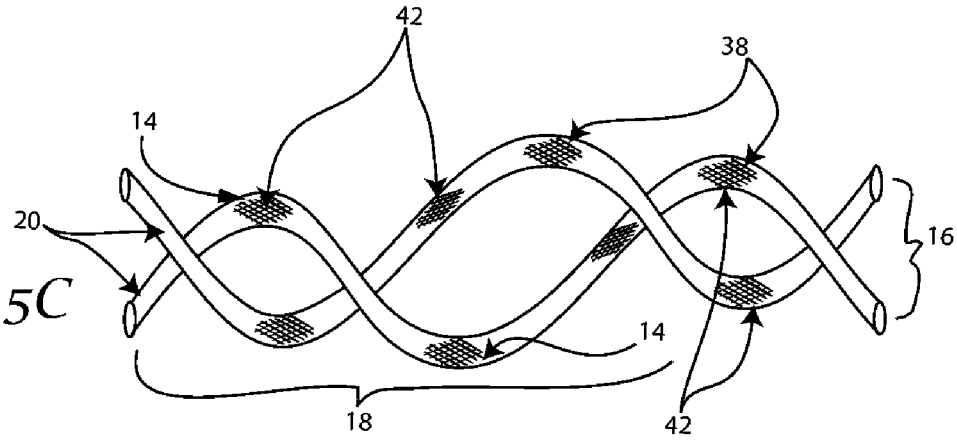
FIG. 5C is a sectional view of still another fabric illustrating the fibers according to an exemplary embodiment of the present invention.

FIG. 5C illustrates fibers 14 having varying insulatory properties across their length. For example, fiber 14 may be blended with fabrics, thread or other materials that provide higher or lower insulatory properties so that across the length of fiber 14 there is a resultant thermal gradation 18. This could include providing thermally graded fibers 20 having a lower insulatory property section 38 that blends or transitions into a mid-range insulatory property section 40 which in turn blends or transitions into a higher insulatory property section 42. The grading of the insulatory properties across the length of fiber 14 provides an overall graded thermal effect within fabric 16. Those skilled in the art can appreciate that the thermal grading does not have to occur just along the length of fiber 14 but may occur along the width or even diagonal of fiber 14 to accomplish the concepts and objectives of the present invention.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. An article of manufacture having the advantage of providing graduated thermal insulatory properties to meet the varying insulatory needs of the human body and extremities, the article comprising:

a thermally graded fabric comprising a non-thermally graded fiber blended with a thermally graded fiber having graduated thermal properties along its length to provide areas with varying insulatory properties in the fabric for serving the insulatory needs of the human body and extremities.

2. The article of claim 1 wherein the thermally graded fiber has an increasing fiber diameter or decreasing fiber diameter along its length in one or more spans of the fabric thereby having a graduated increase or decrease of the insulatory properties in varying areas of the fabric.

3. The article of claim 2 wherein the thermally graded fiber comprises:

a. at least a natural thread having insulatory properties; or b. at least a man-made thread having insulatory properties.

4. The article of claim 1 wherein the thermally graded fiber has an increasing thermal insulatory property or decreasing thermal insulatory property along its length in one or more spans of the fabric to provide a graduated increase or decrease of the insulatory properties in varying areas of the fabric.

5. The article of claim 4 wherein the thermally graded fiber comprises:

a. a blended fiber with a graduated increase or decrease in an amount of fibers incorporated along its length and having higher insulatory properties than the non-thermally graded fiber; or b. a blended fiber with a graduated increase or decrease in an amount of fibers incorporated along its length and having lower insulatory properties than the non-thermally graded fiber.

6. The article of claim 1 wherein the thermally graded fabric includes a graduated blending of thermally graded fibers to the non-thermally graded fibers, wherein fiber count for the thermally graded fibers increases or decreases gradually along one or more spans of the fabric to provide a graduated increase or decrease of the insulatory properties of the fabric.

7. The article of claim 1 wherein the thermally graded fiber varies gradually in thermal insulatory properties along a length, a width, or a diagonal of the fiber.

8. An article of manufacture having the advantage of providing graduated thermal insulatory properties to manage heat retention or loss from the human body and extremities, the article comprising:

a fabric comprising at least a thermal graded insulatory fiber having a fiber count that linearly increases or decreases gradually along its length in one or more spans of the fabric to provide areas in the fabric having a graduated increase or decrease in insulatory properties.

9. The article of claim 8 wherein a diameter of the thermally graded insulatory fiber increases or decreases linearly along a length of the fiber in one or more spans of the fabric to provide areas in the fabric having a graduated increase or decrease in insulatory properties.

10. The article of claim 8 wherein a thermal insulatory property of the thermally graded insulatory fiber increases or decreases linearly along a length of the fiber in one or more spans of the fabric to provide a graduated increase or decrease of the insulatory properties of the fabric.

11. The article of claim 8 wherein the fabric further comprises a non-thermally graded fiber, wherein the ratio of the non-thermally graded fiber to thermally graded insulatory fiber gradually increases or decreases along the one or more spans of the fabric to provide a graduated increase or decrease of the insulatory properties of the fabric.

12. An article of manufacture for wearing or covering the human body and extremities, the article having the advantage of providing graduated thermal insulatory properties to meet the varying thermal insulating needs of the human body and extremities, the article comprising:

a fabric comprising a graduated thermal insulatory fiber having a thermal insulatory property that increases or decreases linearly along a length of the fiber in one or more spans of the fabric to provide a graduated increase or decrease of the insulatory properties of the fabric.

13. The article of claim 12 wherein the fabric is used to provide thermally graded clothing or bedding, wherein the thermally graded clothing or bedding has increasing thermal insulatory properties along the one or more spans adapted for covering human extremities.

14. An article of manufacture having the advantage of providing thermally graded properties to meet the varying insulatory needs of the human body and extremities, the article comprising:

a fabric of woven fibers having graded thermal insulatory properties comprising a gradual and linear varying of ratios of one fiber to another fiber along one or more spans of the fabric.

15. The article of claim 14 wherein the woven fibers include a non-thermally graded fiber blended and at least one:

a. thermally graded fiber having a hollow core of increasing or decreasing diameter along its length;

b. thermally graded fiber having a thermal insulatory property that increases or decreases along its length;

c. thermally graded fiber of increasing or decreasing count; or d. thermally graded solid core fiber.

16. The article of claim 14 wherein one fiber comprises an absorptively graded fiber having an absorption factor that gradually increases or decreases along a length of the fiber in one or more spans of the fabric.

17. The article of claim 14 wherein the ratio of one fiber to another fiber corresponds with heat losses associated with human circulation.

18. The article of claim 14 wherein one fiber comprises a reflectively graded fiber having a reflectance factor that gradually increases or decreases along a length of the fiber in one or more spans of the fabric.

19. An article of manufacture having the advantage of providing thermally graded properties to meet the varying insulatory needs of the human body and extremities, the article comprising:

a length of thermally graded fabric comprising a higher insulatory weave in a first span of the fabric, a lower insulatory weave in a second span of the fabric, and a linearly graduated insulatory weave between the two spans providing a linear graduated transition of insulatory properties over the length of the linearly graduated insulatory weave.

* * * * *

UNITED STATES PATENT AND TRADEMARK OFFICE

CERTIFICATE OF CORRECTION

PATENT NO. : 8,129,295 B2
APPLICATION NO. : 12/134982
DATED : March 6, 2012
INVENTOR(S) : Aasgaard It is certified that error appears in the above-identified patent and that said Letters Patent is hereby corrected as shown below:

Col. 9, Claim 8, Line 15:
DELETE after at least a "thermal"
ADD after at least a --thermally--

Signed and Sealed this
Seventeenth Day of April, 2012

David J. Kappos

David J. Kappos
*Director of the United States Patent and Trademark Office*